US011384485B2

(12) United States Patent
Nguyen

(10) Patent No.: US 11,384,485 B2
(45) Date of Patent: Jul. 12, 2022

(54) RAIL CLIP ASSEMBLY AND SNAP LOCK TOE INSULATOR FOR SAME

(71) Applicant: Progress Rail Services Corporation, Albertville, AL (US)

(72) Inventor: Thai Nguyen, Shawnee, KS (US)

(73) Assignee: Progress Rail Services Corporation, Albertville, AL (US)

( * ) Notice: Subject to any disclaimer, the term of this patent is extended or adjusted under 35 U.S.C. 154(b) by 309 days.

(21) Appl. No.: 16/811,683

(22) Filed: Mar. 6, 2020

(65) Prior Publication Data

US 2021/0277608 A1 Sep. 9, 2021

(51) Int. Cl.
*E01B 9/30* (2006.01)
*E01B 9/48* (2006.01)

(52) U.S. Cl.
CPC ..... *E01B 9/306* (2013.01); *E01B 9/30* (2013.01); *E01B 9/486* (2013.01)

(58) Field of Classification Search
CPC . E01B 9/306; E01B 9/30; E01B 9/486; E01B 9/483; E01B 2205/00
USPC ..... 238/349, 351
See application file for complete search history.

(56) References Cited

U.S. PATENT DOCUMENTS 3,246,843 A * 4/1966 Pineau ..... E01B 9/306 238/349
4,179,067 A * 12/1979 Baier ..... E01B 9/306 238/349
4,327,865 A * 5/1982 Greene ..... E01B 9/306 238/349
5,865,370 A * 2/1999 Sonneville ..... E01B 9/306 238/354
6,923,381 B2 * 8/2005 Marshall ..... E01B 9/303 238/351
9,315,947 B2 4/2016 Cox et al.
2004/0056108 A1 * 3/2004 Marshall ..... E01B 9/303 238/251
2013/0306747 A1 * 11/2013 Cox ..... E01B 9/306 238/351
2018/0051422 A1 * 2/2018 Nguyen ..... E01B 5/00

FOREIGN PATENT DOCUMENTS

GB 666153 A 2/1952
GB 869666 A * 6/1961 ..... E01B 9/306
GB 2536693 9/2016
JP H0747442 Y2 11/1995
RU 2280724 C2 7/2006
RU 185122 U1 11/2018
WO 0231264 4/2002
WO 2012104600 8/2012

* cited by examiner

*Primary Examiner* — Zachary L Kuhfuss
(74) *Attorney, Agent, or Firm* — Brannon Sowers & Cracraft

(57) ABSTRACT

A rail clip assembly includes a rail clip, and a toe insulator having a pad with a diagonally oriented rail contact face, and an open-sided pocket receiving a toe end of a rail clip. The toe insulator includes a snap lock, structured to adjust between a locked configuration trapping a locating projection of the toe insulator in a bore in the rail clip, and an unlocked configuration.

20 Claims, 4 Drawing Sheets

RAIL CLIP ASSEMBLY AND SNAP LOCK TOE INSULATOR FOR SAME

TECHNICAL FIELD

The present disclosure relates generally to fastening track rail, and more particularly to a rail clip assembly having a toe insulator with a rail contact pad and a snap lock to enable locking or unlocking the toe insulator to a rail clip.

BACKGROUND

Track rail fastening systems are used the world over, and range in complexity from simple metal plates and clips or clamps, to composite structures employing multiple metallic body components and overmolded polymeric materials for vibration mitigation and cushioning. In many systems, a device known as a rail clip is used to clamp a section of track rail to a pad or pad assembly. Rail clips are typically positioned at intervals along both sides of a section of track rail.

So-called E-clips or the like are used in some systems as rail clips, and may include a shaft or shank portion that is received within a bore in a track rail fastener oriented generally along a length of the track rail. A clamping portion extends onto and exerts a downward clamping force against a base portion of a section of the track rail. Other systems employ clips that are more or less C-shaped and include a base end inserted into a laterally extending recess in a fixed shoulder cast in place in an underlying concrete substrate. An end or toe portion commonly equipped with a non-metallic insulator clamps down upon the base portion of a section of the track rail. One example rail clip mechanism is known from Japanese Patent Publication No. JPH0747422Y2. While the concept set forth in this disclosure may have various applications, there is always room for improvement and/or alternative strategies.

SUMMARY OF THE INVENTION

In one aspect, a rail clip assembly includes a rail clip having a base end, a toe end, a middle spring section having a recurving shape and extending between the base end and the toe end, and an outer clip surface and an inner clip surface each formed in part upon the base end, the toe end, and the middle spring section. An insulator bore is formed in the toe end and opens at each of the outer clip surface and the inner clip surface. The rail clip assembly further includes a toe insulator having a pad with an inner pad surface in contact with the inner clip surface, an outer pad surface having a rail contact face oriented diagonally relatively to the toe end, and a locating projection extending upwardly from the inner pad surface through the insulator bore and including a first engagement surface. The toe insulator further includes a snap lock, the snap lock having an insulator retention surface facing the outer clip surface at locations outboard of the insulator bore, and a second engagement surface. The second engagement surface is in contact with the first engagement surface, such that the snap lock is in a locked configuration trapping the locating projection within the insulator bore, and is adjustable to an unlocked configuration where the locating projection is removable from the insulator bore for decoupling the toe insulator from the rail clip.

In another aspect, a rail clip assembly includes a rail clip having a base end, a toe end, a middle spring section having a recurving shape and extending between the base end and the toe end, and an insulator bore formed in the toe end. The rail clip assembly further includes a toe insulator including a pad with an inner pad surface in contact with the toe end, an outer pad surface having a rail contact face oriented diagonally relative to the toe end, and a locating projection extending upwardly from the inner pad surface through the insulator bore. The toe insulator further includes a snap lock, separate from the pad, and structured to engage with the locating projection in a locked configuration trapping the locating projection in the insulator bore and locking the toe insulator to the rail clip. The snap lock is deformable in opposition to an internal bias to adjust the toe insulator to an unlocked configuration permitting disengagement of the toe insulator from the rail clip.

In still another aspect, a toe insulator for a rail clip includes a pad having an inner pad surface, an outer pad surface with a rail contact face, and a locating projection extending upwardly from the inner pad surface and including a first engagement surface. The pad further includes a plurality of inner peripheral surfaces forming, together the inner pad surface, an open-sided pocket for receiving a toe end of a rail clip. The toe insulator further includes a snap lock having an insulator retention surface facing the inner pad surface at locations outboard of the locating projection, and a downwardly projecting prong including a second engagement surface. The toe insulator further includes an axially extending lock bore formed in the locating projection, and the downwardly extending prong is positionable in the axially extending lock bore to contact the second engagement surface to the first engagement surface. The downwardly projecting prong is deformable in opposition to an internal bias to adjust the toe insulator from a locked configuration, where the second engagement surface is in contact with the first engagement surface for trapping the locating projection within an insulator bore in the rail clip, to an unlocked configuration where the snap lock is separable from the pad and the locating projection is removable from the insulator bore.

DETAILED DESCRIPTION

Figure 1:
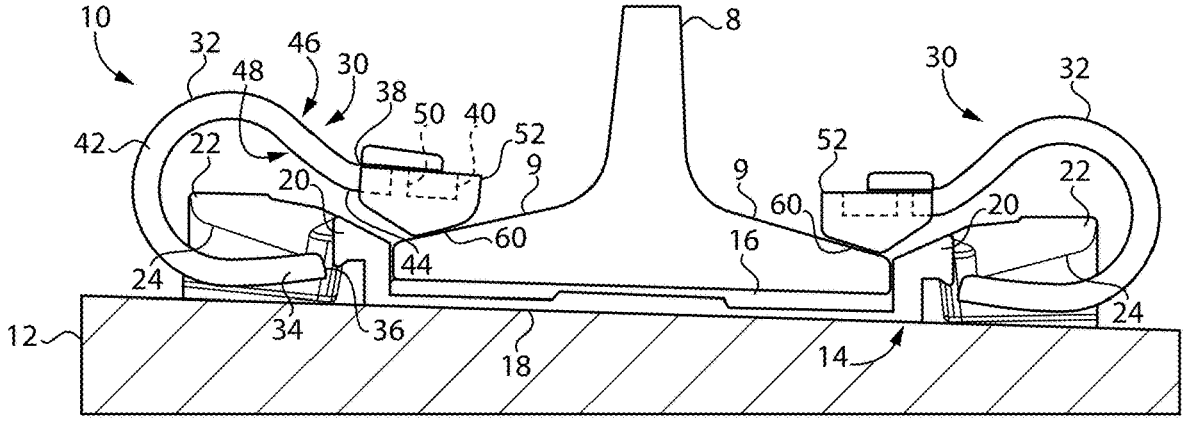
FIG. 1 is a partially sectioned diagrammatic view of a rail fastening system fastening a track rail, according to one embodiment.
Figure 2:
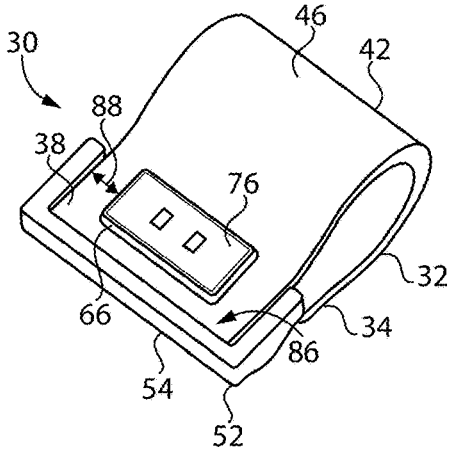
FIG. 2 is an isometric view of a rail clip assembly, according to one embodiment.
Figure 3:
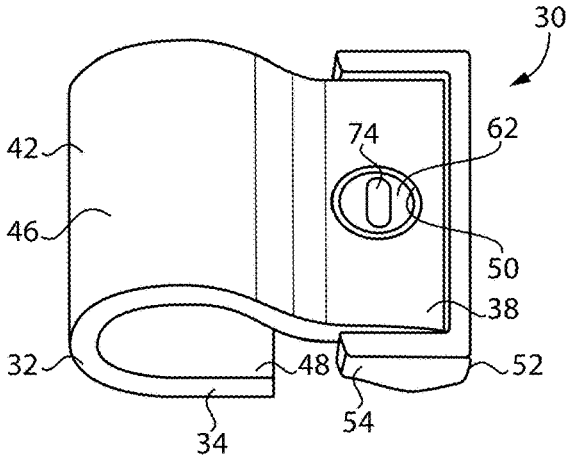
FIG. 3 is another isometric view of a rail clip assembly, according to one embodiment.
Figure 4:
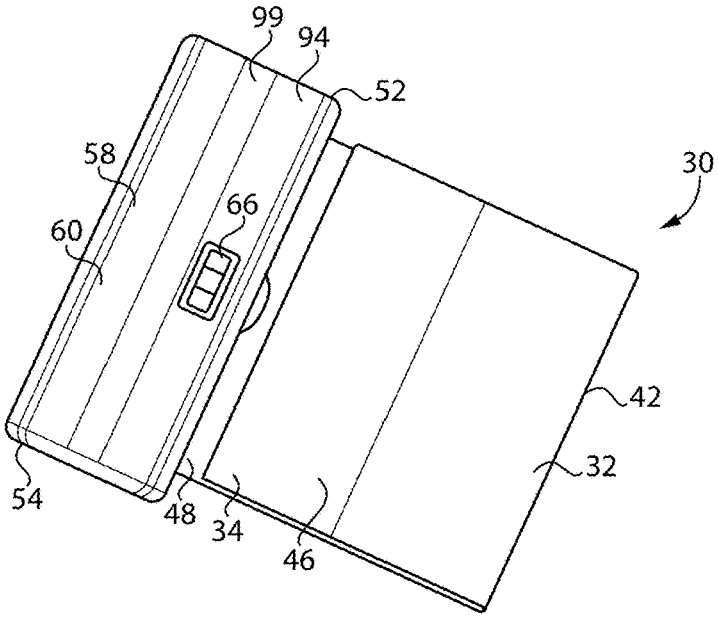
FIG. 4 is yet another an isometric view of a rail clip assembly, according to one embodiment.
Figure 5:
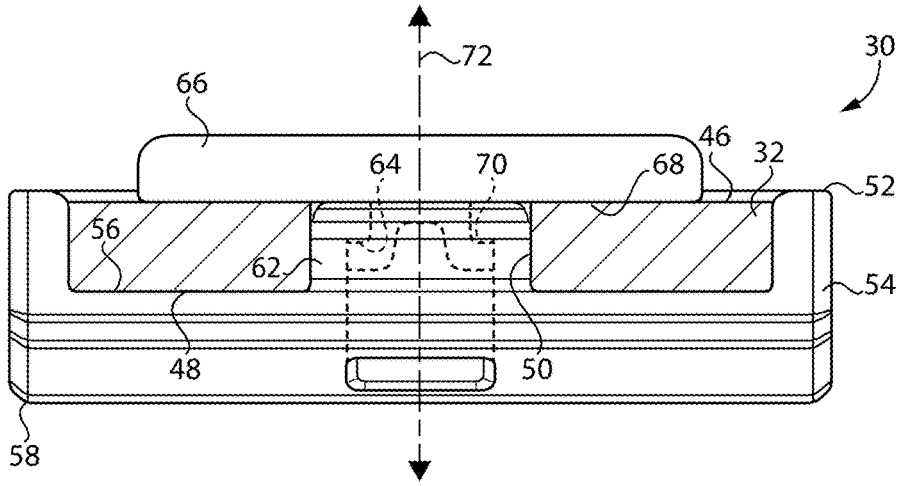
FIG. 5 is a partially sectioned back side view of a rail clip assembly, according to one embodiment.

Referring to FIG. 1, there is shown a track rail fastening system 10 fastening a track rail 8 to a substrate 12, such as a concrete tie. Track rail fastening system 10 includes a rail pad assembly 14 including a pad 16 with track rail 8 supported thereon. Pad 16 can be positioned upon an abrasion plate 18 in contact with substrate 12. Abrasion plate 18 may be generally flat and planar with upwardly projecting side posts 20 upon either side, and integrated as a single molded or fabricated piece. Shoulders 22 may be positioned upon either side of and coupled with side posts 20. Those skilled in the art will envision other rail pad assembly configurations that might suitably be applied in the present context. Track rail 8 includes upper surfaces 9 oriented generally diagonally to a horizontal plane, and track rail fastening system 10 further includes a rail clip assembly 30 positioned upon each of opposite sides of track rail 8 and supported within shoulders 22. Shoulders 22 may be cast in place within concrete material or the like of substrate 12, although the present disclosure is not thereby limited. As will be further apparent from the following description, each rail clip assembly 30, which may be substantially identical to one another and hereinafter referred to in the singular, may be structured for improved performance and serviceability as compared with certain known rail clip assembly designs.

Rail clip assembly 30 includes a rail clip 32 formed, for example, of an elongate substantially rectangular plate bent to a desired configuration, and having a base end 34 terminating at a base tip 36, a toe end 38 terminating at a toe end tip 40, and an arcuate middle spring section 42. Each of base end 34 and toe end 36 may be substantially straight, and together with middle spring section 42 form profiles similar to a question mark. A bend 44 transitions between middle spring section 42 and toe end 38 and orients toe end 38 to project toward track rail 8 relatively further than the projection of base end 34. Middle section 42 has a recurving shape and extends between base end 34 and toe end 36. Rail clip 32 further includes an outer clip surface 46 and an inner clip surface 48 each formed in part upon base end 34, toe end 38, and middle spring section 42. An insulator bore 50 is formed in toe end 38 and opens at each of outer clip surface 46 and inner clip surface 48.

Referring also now to FIGS. 2-5, rail clip assembly 30 further includes a toe insulator 52 formed, for example, of a non-metallic material such as an elastomeric material, a rubber or rubber-like material, or still another. In some embodiments toe insulator 52 could include a metallic core encased, partially encased, or coated with a non-metallic material. Toe insulator 52 includes a pad 54 having an inner pad surface 56 in contact with inner clip surface 48, and an outer pad surface 58 having a rail contact face 60 oriented diagonally relative to toe end 38. Pad 54 may also include inner peripheral surfaces 84 bordering inner pad surface 56, such as upon three sides, and forming an open-sided pocket 86 receiving toe end 38 of rail clip 32. Pad 54 may also include a locating projection 62 extending upwardly from inner pad surface 56 through insulator bore 50 and including a first engagement surface 64.

Toe insulator 52 further includes a snap lock 66. Snap lock 66 may include a plate 76, and an insulator retention surface 68 upon plate 76. Insulator retention surface 68 faces outer clip surface 46, and faces inner pad surface 56, at locations outboard of insulator bore 50. In this context, "outboard" is used in reference to insulator bore 50 and means away from insulator bore 50 in any radial direction, whereas "inboard" means an opposite direction or orientation. Snap lock 66 includes a second engagement surface 70. Second engagement surface 70 is in contact with first engagement surface 64, in FIGS. 1, 2, 4, and 5, such that snap lock 66 is in a locked configuration trapping locating projection 62 with insulator bore 50. Snap lock 66 is removed in the illustration of FIG. 3. Snap lock 66 is adjustable to an unlocked configuration where locating projection 62 is removable from insulator bore 50 for decoupling toe insulator 52 from rail clip 32. Pad 54 and snap lock 66 may be separate pieces disconnected in the unlocked configuration, although the present disclosure is not thereby limited. Plate 76 may include outer peripheral surfaces 82 forming a rectangular shape. In the illustrated embodiment, a clearance 88 extends between outer peripheral surfaces 82 and inner peripheral surfaces 84.

Figure 6:
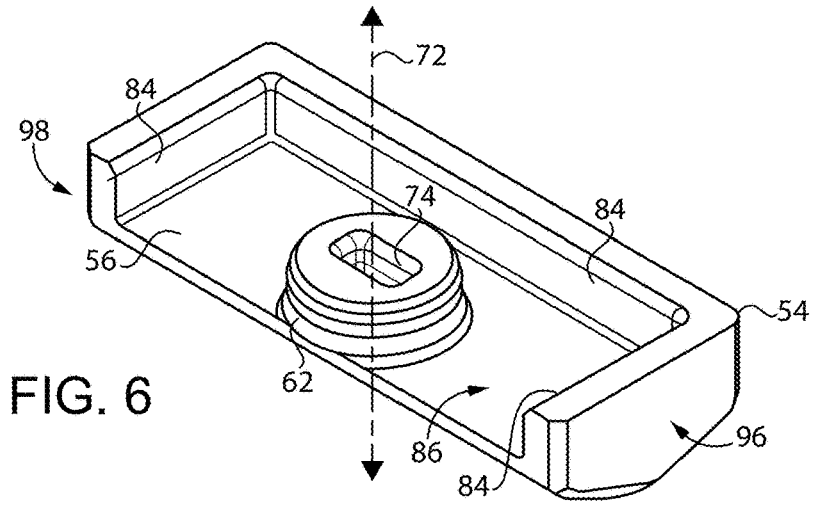
FIG. 6 is a diagrammatic view of a pad for a toe insulator, according to one embodiment.
Figure 7:
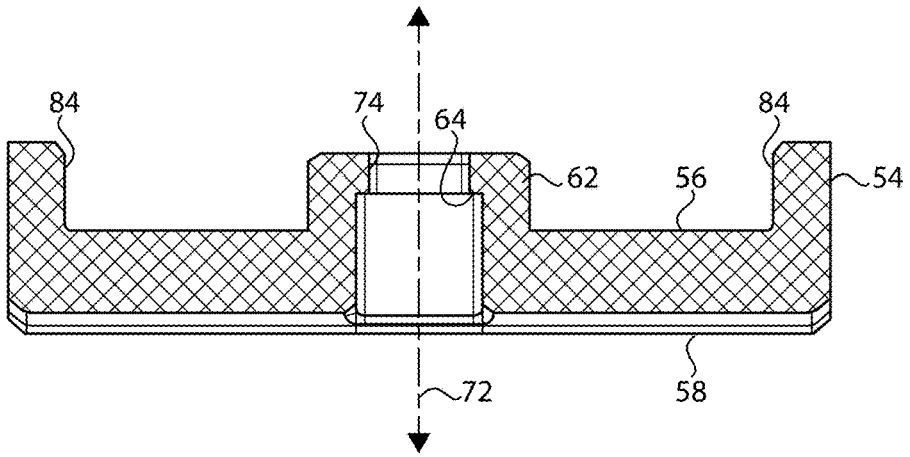
FIG. 7 is a sectioned view through the pad of FIG. 6.
Figure 8:
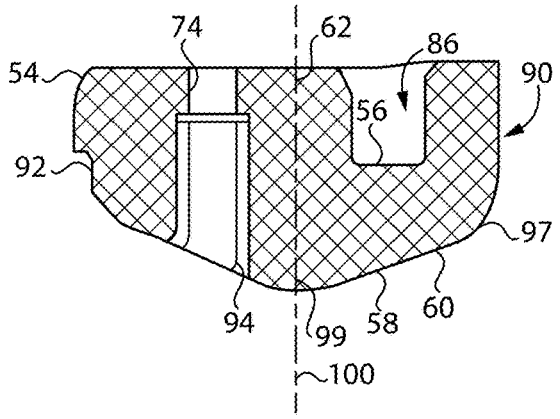
FIG. 8 is another sectioned view through the pad of FIGS. 6 and 7.

Referring also now to FIGS. 6-8, locating projection 62 defines a projection axis 72, and has formed therein an axially extended lock bore 74. First engagement surface 64 and second engagement surface 70 may each have transverse orientations relative to projection axis 72 and are within axially extending lock bore 74 in the locked configuration. Insulator bore 50 may be cylindrical, and axially extending lock bore 74 may be non-cylindrical, for example having an elongated roughly oval or rectangular shape as depicted in FIG. 6. In a practical implementation, each of the respective pieces of toe insulator 52 forming pad 54 and snap lock 66 may include molded non-metallic materials, including known polymeric materials or elastomeric materials suitable for injection molding. Pad 54 and snap lock 66 may each be formed throughout of non-metallic material. In other instances snap lock 66 and pad 54 might be machined, compression molded, or formed by any other suitable technique.

Pad 54 may further include a front face 90, a back face 92, and a transverse face 94 oriented diagonally relative to rail contact face 60 so as to form a V-profile, together with rail contact face 60, from front face 90 to back face 92. Each of front face 90 and back face 92 may extend from a first pad end 96 to a second pad end 98. A first radiused edge or radius 97 may transition between front face 90 and rail contact face 60. A second radiused edge or radius 99 may transition between rail contact face 60 and transverse face 94. Each of radius 97 and radius 99 may extend from first pad end 96 to second pad end 98. In one embodiment, a plane 100 as shown in FIG. 8 bisects the V-profile, intersecting radius 99, at a location mid-way between front face 90 and back face 92. Plane 100 may be oriented normal to inner pad surface 56, which may be planar.

Figure 9:
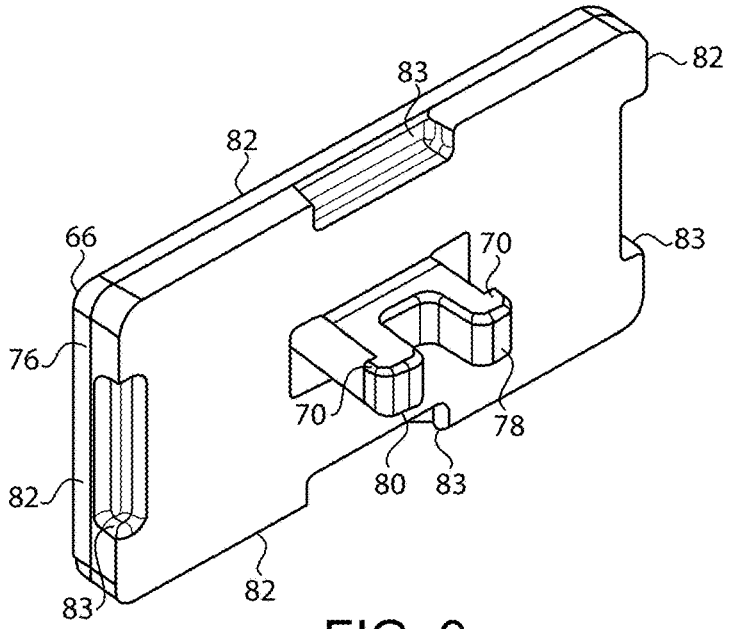
FIG. 9 is a diagrammatic view of a snap lock for a toe insulator, according to one embodiment.
Figure 10:
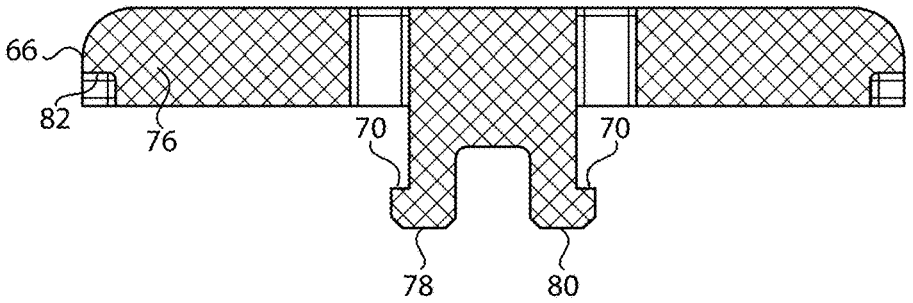
FIG. 10 is a sectioned view through the snap lock of FIG. 9.

Turning also now to FIGS. 9 and 10, snap lock 66 may further include a downwardly projecting prong, in the illustrated case two such prongs, including a first downwardly projecting prong 78 and a second downwardly projecting prong 80, including second engagement surface 70. Second engagement surface 70 may thus be formed in part upon each one of downwardly projecting prongs 78 and 80. Downwardly projecting prongs 78 and 80 may be elastically deformable, each in opposition to an internal bias, in radially inward directions, to adjust snap lock 66 from a locked configuration to the unlocked configuration. Recesses 83 may be formed in outer peripheral surfaces 82, and accessible to a user by way of clearance 88 when rail clip assembly 30 is assembled. A technician could insert a pry tool or the like into recesses 83, and using the pry tool as a lever pop snap lock 66 out of engagement with locating projection 62, elastically deforming downwardly projecting prongs 78 and 80 to disengage first engagement surface 64 from second engagement surface 70, and thus decouple toe insulator 52 from rail clip 32. Snap lock 66 may thus be understood to have a biased state where prongs 78 and 80 are deformed inwardly, and a rest state. Downwardly projecting prongs 78 and 80 may be elastically deformable in opposition to internal bias to adjust toe insulator 52 from the locked configuration, where second engagement surface 70 is in contact with first engagement surface 64, for trapping locating projection 62 within insulator bore 50 in rail clip 32, to an unlocked configuration where snap lock 66 is separable from pad 54 and locating projection 62 is removable from insulator bore 50.

INDUSTRIAL APPLICABILITY

Figure 11:
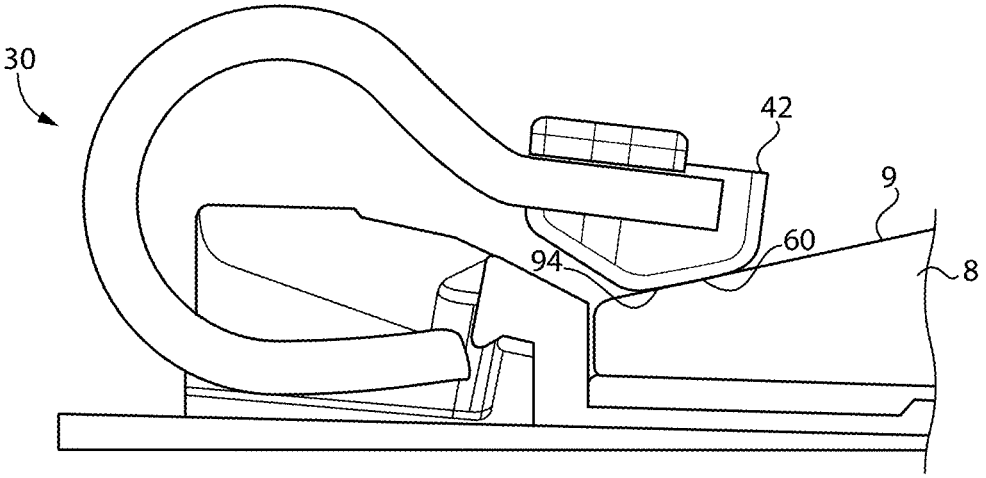
FIG. 11 is a diagrammatic view of a rail clip assembly in a rail fastening system, in one configuration.
Figure 12:
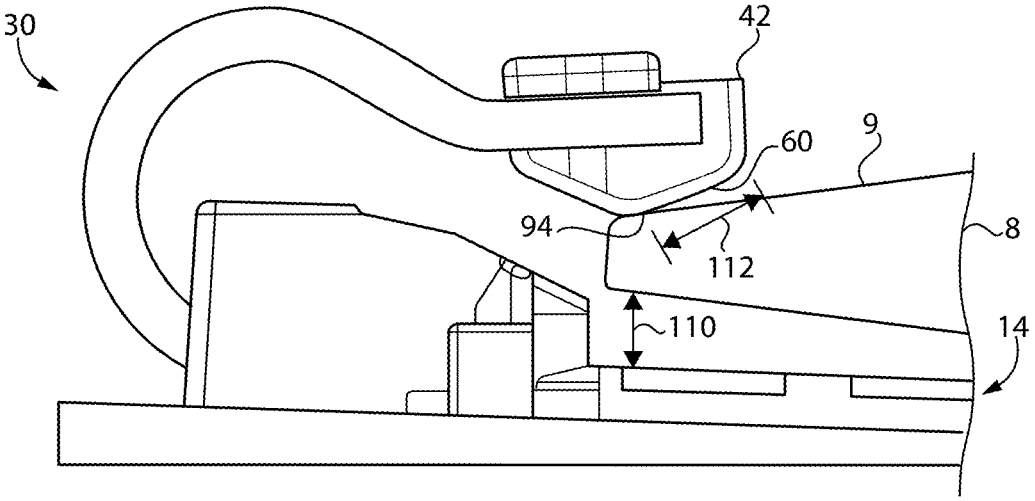
FIG. 12 is a diagrammatic view of a rail clip assembly in a rail fastening system in another configuration.

Referring to the drawings generally, but also now to FIG. 11 and FIG. 12, when rail clip assembly 30 is installed for service the internal spring force produced by rail clip 32 can be exerted generally downward upon upper surfaces 9 of track rail 8. Each of shoulders 22 may include an internal bore or recess 24 that receives the respective base end 34. During installation, using an installation machine or manually by a technician, rail clip assembly 30 may be positioned adjacent to a shoulder 22, and middle spring section 42 struck with an installation tool to simultaneously insert base end 34 into recess 24, place middle spring section 42 in tension, and exert downward clamping pressure on upper surface 9. During service, track rail 8 can experience loads causing track rail 8 to rotate or rock laterally, potentially lifting track rail 8 so as to form a clearance 110 between track rail 8 and rail pad assembly 14. When the load subsides, spring force exerted by rail clip assembly 30 can assist in returning track rail 8 down to a stable seated position upon rail pad assembly 14. The spring force can also reduce a tendency for track rail 8 to lift from substrate 12 at all.

In certain known rail clip assembly designs, insulators could be expected in such situations to rotate upward and around the corresponding rail clip end so as to deform, potentially plastically, and reduce the clamping load that might otherwise be applied. This phenomenon is believed to be due to various factors, but including insufficient rail contact surface area and limited mounting stability of the toe insulator itself. In the case of rail clip assembly 30, rail contact face 60 has a contact length 112 that is relatively larger than certain known designs, for instance greater than 10 millimeters, and can assist in maintaining contact with upper surface 9 of track rail 8, as well as providing a relatively longer plane contact length upon upper surface 9 to inhibit rocking of rail 8. Moreover, the radiused surfaces formed by radius 97 and radius 99, can assist in enabling pad 54 to controllably rock against the tilting upper rail surface 9, and smoothly transition between loaded and tilted versus unloaded and stable states such as those depicted, respectively, in FIG. 11 and FIG. 12. In addition, the positive locking of toe insulator 52 by way of the snap lock 66 and increased pad to rail contact length is contemplated to assist in resisting rotation of toe insulator 52 about toe and tip 40 as might be observed in certain other designs.

While in some systems a toe insulator is irreversibly attached, meaning removal without permanent deformation or other damage is impossible or impractical, in accordance with the present disclosure toe insulator 52 can be relatively easily removed in the field and either reinstalled or swapped for a new toe insulator. It should also be appreciated that while the use of a downwardly extending prong within an axially extending lock bore provides a practical implementation strategy for contact of engagement surfaces as discussed herein, the present disclosure is not thereby limited. In other instances, an upwardly extending prong might be formed on pad 54 and engaged within a bore formed in snap lock 66. Analogously, rather than engagement surfaces internal to a projection or the like, another strategy might be used employing engagement surfaces formed externally.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A rail clip assembly comprising:

a rail clip having a base end, a toe end, a middle spring section having a recurving shape and extending between the base end and the toe end, and an outer clip surface and an inner clip surface each formed in part upon the base end, the toe end, and the middle spring section, and an insulator bore is formed in the toe end and opens at each of the outer clip surface and the inner clip surface;

a toe insulator including a pad having an inner pad surface in contact with the inner clip surface, an outer pad surface having a rail contact face oriented diagonally relative to the toe end, and a locating projection extending upwardly from the inner pad surface through the insulator bore and including a first engagement surface;

the toe insulator further including a snap lock, the snap lock having an insulator retention surface facing the inner clip surface at locations outboard of the insulator bore, and a second engagement surface; and the second engagement surface is in contact with the first engagement surface, such that the snap lock is in a locked configuration trapping the locating projection within the insulator bore, and is adjustable to an unlocked configuration where the locating projection is removable from the insulator bore for decoupling the toe insulator from the rail clip.

2. The rail clip assembly of claim 1 wherein the pad and the snap lock are separate pieces disconnected in the unlocked configuration.

3. The rail clip assembly of claim 1 wherein:

the locating projection defines a projection axis, and has formed therein an axially extending lock bore; and the first engagement surface and the second engagement surface have transverse orientations relative to the projection axis and are within the axially extending lock bore in the locked configuration.

4. The rail clip assembly of claim 3 wherein the snap lock includes a plate including the insulator retention surface, and a downwardly projecting prong including the second engagement surface.

5. The rail clip assembly of claim 4 wherein:

the downwardly projecting prong is one of two downwardly projecting prongs and the second engagement surface is formed in part upon each of the two downwardly projecting prongs;

the downwardly projecting prongs are elastically deformable, each in opposition to an internal bias, in radially inward directions, to adjust the snap lock from the locked configuration to the unlocked configuration.

6. The rail clip assembly of claim 4 wherein the rail clip is formed of a metallic material, and each of the pad and the snap lock is formed throughout of a non-metallic material.

7. The rail clip assembly of claim 4 wherein:

the plate includes outer peripheral surfaces forming a rectangular shape;

the pad includes inner peripheral surfaces bordering the inner pad surface and forming an open-sided pocket receiving the toe end section of the rail clip; and a clearance extends between the outer peripheral surfaces and the inner peripheral surfaces.

8. The rail clip assembly of claim 3 wherein the insulator bore is cylindrical, and the axially extending lock bore is non-cylindrical.

9. The rail clip assembly of claim 1 wherein the pad further includes a front face, a back face, and a transverse face oriented diagonally relative to the rail contact face so as to form a V-profile, together with the rail contact face, from the front face to the back face.

10. The rail clip assembly of claim 9 wherein a plane bisects the V-profile at a location mid-way between the front face and the back face.

11. A rail clip assembly comprising:

a rail clip having a base end, a toe end, a middle spring section having a recurving shape and extending between the base end and the toe end, and an insulator bore is formed in the toe end;

a toe insulator including a pad having an inner pad surface in contact with the toe end, an outer pad surface having a rail contact face oriented diagonally relative to the toe end, and a locating projection extending upwardly from the inner pad surface through the insulator bore;

the toe insulator further including a snap lock, separate from the pad, and structured to engage with the locating projection in a locked configuration trapping the locating projection in the insulator bore and locking the toe insulator to the rail clip; and the snap lock is deformable in opposition to an internal bias to adjust the toe insulator to an unlocked configuration permitting disengagement of the toe insulator from the rail clip.

12. The rail clip assembly of claim 11 wherein:

the locating projection defines a projection axis;

the snap lock includes a plate, and downwardly projecting prongs engaged with the locating projection; and the downwardly projecting prongs are elastically deformable, in radially inward directions, in opposition to the internal bias to adjust the toe insulator to the unlocked configuration.

13. The rail clip assembly of claim 12 wherein:

an axially extending lock bore is formed in the locating projection; and the downwardly projecting prongs are engaged with the locating projection within the axially extending lock bore.

14. The rail clip assembly of claim 11 wherein the pad further includes a front face, a back face, and a transverse face oriented diagonally relative to the rail contact face so as to form a V-profile, together with the rail contact face, from the front face to the back face.

15. The rail clip assembly of claim 14 wherein:

the pad includes a plurality of inner peripheral surfaces; and an open-sided pocket receiving the toe end of the rail clip is formed by the inner pad surface and the plurality of inner peripheral surfaces.

16. The rail clip assembly of claim 14 wherein a plane bisects the V-profile between the front surface and the back surface and is oriented normal to the inner pad surface.

17. A toe insulator for a rail clip comprising:

a pad including an inner pad surface, an outer pad surface having a rail contact face, and a locating projection extending upwardly from the inner pad surface and including a first engagement surface;

the pad further including a plurality of inner peripheral surfaces forming, together with the inner pad surface, an open-sided pocket for receiving a toe end of a rail clip;

a snap lock having an insulator retention surface facing the inner pad surface at locations outboard of the locating projection, and a downwardly projecting prong including a second engagement surface;

an axially extending lock bore is formed in the locating projection, and the downwardly extending prong is positionable in the axially extending lock bore to contact the second engagement surface to the first engagement surface; and the downwardly projecting prong is deformable in opposition to an internal bias to adjust the toe insulator from a locked configuration, where the second engagement surface is in contact with the first engagement surface for trapping the locating projection within an insulator bore in the rail clip, to an unlocked configuration where the snap lock is separable from the pad and the locating projection is removable from the insulator bore.

18. The toe insulator of claim 17 wherein the locating projection defines a projection axis, and the first engagement surface and the second engagement surface each extend at transverse orientations to the projection axis.

19. The toe insulator of claim 17 wherein the pad further includes a front face, a back face, and a transverse face oriented diagonally relative to the rail contact face so as to form a V-profile, together with the rail contact face, between the front face and the back face.

20. The toe insulator of claim 19 wherein:

the snap lock includes a plate having outer peripheral surfaces forming a rectangular shape;

the pad includes inner peripheral surfaces bordering the inner pad surface and forming the open-sided pocket; and a clearance extends between the outer peripheral surfaces and the inner peripheral surfaces.

* * * * *